United States Patent [19]

Moult et al.

[11] 4,326,669

[45] Apr. 27, 1982

[54] LAMINATED WOODEN RAILROAD CROSSITE HAVING EXPOSED END-GRAIN FORMING PART OF THE LOAD BEARING SURFACE

[75] Inventors: Roy H. Moult, Murrysville; Craig R. McIntyre, Export, both of Pa.

[73] Assignee: Koppers Company, Inc., Pittsburgh, Pa.

[21] Appl. No.: 914,180

[22] Filed: Jun. 9, 1978

[51] Int. Cl.[3] ..... E01B 3/02

[52] U.S. Cl. ..... 238/36; 428/535

[58] Field of Search ..... 238/29, 30, 36, 37, 238/83; 428/535

[56] References Cited

U.S. PATENT DOCUMENTS

| | | | |
|---|---|---|---|
| 598,127 | 2/1898 | Williams | 238/37 |
| 1,523,105 | 1/1925 | Doe | 428/535 |
| 2,257,833 | 10/1941 | Bäsler et al. | 238/83 |
| 3,285,146 | 11/1966 | Miller | 238/29 |
| 4,105,159 | 8/1978 | Brown | 238/36 |

FOREIGN PATENT DOCUMENTS

| | | | |
|---|---|---|---|
| 1021965 | 2/1953 | France | 238/37 |

OTHER PUBLICATIONS

Burmester, "Improvement of the Resistance of Wood to Transverse Pressure", *Holz-Zentralblatt*, Oct. 11, 1965, pp. 121-123.

*Primary Examiner*—Joseph F. Peters, Jr.
*Assistant Examiner*—Ross Weaver
*Attorney, Agent, or Firm*—Donald M. MacKay; Herbert J. Zeh, Jr.

[57] ABSTRACT

A laminated wooden load support structure is described herein, wherein at least one of the lamina is comprised of a plurality of wooden elements orientated with respect to the load bearing surface or wear surface such that the end-grains of the wood elements of the lamina form a part of the load bearing surface.

7 Claims, 7 Drawing Figures

LAMINATED WOODEN RAILROAD CROSSITE HAVING EXPOSED END-GRAIN FORMING PART OF THE LOAD BEARING SURFACE

BACKGROUND OF THE INVENTION

This invention relates to railroad crossties, more particularly, to laminated wooden railroad crossties.

In the conventional construction of railroad wooden crossties, a tie plate carrying a rail is disposed upon the surface of the wooden tie. As a train passes over a crosstie, a load is imparted to the crosstie through the rail and tie plate. The tie plate spreads and distributes the load to the crosstie surface beneath the tie plate. The area of the tie beneath the tie plate is commonly referred to as the wear area because this is the area that tends to disintegrate sooner than do the other areas of the tie.

Conventionally, spikes are driven through holes that are disposed near the lateral edge of the tie plate and lodged in the crosstie. These spikes secure the rail to the tie plate and likewise secure the tie plate to the wooden tie to restrict horizontal and vertical movement of the rail as a train passes over the rails.

Customarily, each of the two rails of a railroad track are canted inwardly by the tie plate being disposed at a slope of one unit of rise to forty units of run, to improve the load bearing qualities and to help maintain the gauge (distance between the rails) of the rails, particularly when a train passes. Actually, the spikes primarily hold the gauge. Because each rail is canted inwardly of the track, the passing of train wheels over the track tends to cause slight amount of horizontal movement to occur in conjunction with a slight amount of vertical movement of the rail. This combination of vertical and horizontal motion tends to effect a rocking movement of the tie plate and tie, which movement in turn causes an indentation in the tie; a phenomena known in the railroad industry as tie or plate cutting, i.e., the cutting or wearing of the wooden tie in the tie wear area. This plate cutting is accelerated by a number of factors. For instance, moisture under the tie plate softens the wood fibers of the wear area. Dust and abrasive particles from the road bed become trapped under the tie plate; consequently, the rocking movement of the plate under the load and vibration of passing trains literally grinds the abrasive particles under the tie plate into the tie, destroying the supporting characteristics of the wood fibers of the tie in the wear area. Because of this wearing or plate cutting, ties must be replaced often.

Hardwoods such as red and white oaks, tupelo, sweetgum, and beech have been the most popular type of wood for employment in construction of railroad ties because of hardwood's superior wear characteristics. However, one particularly favored type of hardwood used to construct crossties is oak. However, the available supply of hardwood fluctuates. Unexpected forest fires and droughts can deplete available supplies of hardwood and supplies of hardwood are not easily replenished due to the extended growth cycle of hardwood. In addition, hardwood is increasingly being diverted to other product areas. Parenthetically, it should be noted that the construction of conventional crossties results in a high percentage of wasted wood.

Laminated wooden crossties have been proposed to allow more efficient utilization of available supplies of wood. Laminated crossties are created by laminating individual lamina to form a crosstie. The conventional laminated crosstie is constructed such that each lamina is a unitary wooden element laminated to have generally their grains parallel to one another. The lamina are bonded together, and usually chemically treated to arrest decay and insect attack.

The laminated wooden crosstie has exhibited field performance comparable to conventional unitary crossties. However, laminated wooden crossties have a purchase price much higher than that of conventional crossties. Attempts to lessen the financial impact of laminated ties has centered on improvement in the load capacity and wear characteristics of laminated ties. Improved crosstie load capability enables one to deploy fewer crossties, and improved wear characteristics results in a longer crosstie useful life. Efforts to increase the load and wear characteristics of laminated crossties have involved such suggestions as impregnating the crosstie with a plastic resin and using wooden inserts beneath the tie plate implanted in the crosstie. These suggestions to increase the load and wear characteristic of laminated crossties has met with limited success.

The present invention offers more efficient utilization of wood material. The present invention also offers superior wear resistance and load bearing capacity for crossties. The invention allows one to deploy less expensive and more plentiful softwood without appreciable degradation of crosstie performance. The invention further allows one to design a crosstie which best compliments the type of rail traffic expected to be encountered, e.g., lightweight intracity commuter rails can employ ties with a minimum of hardwood, resulting in less material costs and still derive the performance advantages of the present invention.

SUMMARY OF THE INVENTION

A laminated wooden railroad crosstie consisting of at least one lamina including a plurality of generally rectangular wooden elements in the wear area of the tie, which elements are oriented within the crosstie such that their end-grains are exposed, forming part of the wear surface. The type of wood used to construct the crosstie may be either of the hardwood variety or the less expensive softwood variety, or a combination of hard and softwood. Because of the presence of the wood elements, which are relatively small, less wood is wasted.

DETAILED DESCRIPTION OF THE PREFERRED EMBODIMENT

A tree is an anatomically complex structure, being comprised of structural elements which are, in the main, long pointed cells known as fibers which vary in length within a tree and among the species of the trees, but generally range from one millimeter to about eight millimeters in length, and are firmly grown together. The cells that are immediately under the bark of the tree and that take an active part in the life process of the tree are called "sapwood". The inner sapwood cells that have become inactive are called heartwood. Each year a tree produces a well-marked growth ring of the sapwood. These growth rings are generally visible as the tree is cut transversely to its length.

In cutting a tree into lumber or into ties, a tree is generally cut so as to produce one or more pieces of lumber. The surface of the lumber which shows those fibers that have extended longitudinally of the length of the tree which became the lumber or tie is referred to as showing "side-grain". When the surface was cut at right angles to the longitudinal axis of the tree, it is generally possible to distinguish some arc of the circle or growth ring of the tree, and this is referred to as showing the "end-grain". Those familiar with lumber can readily distinguish between the "end-grain" and the "side-grain" of the lumber.

Figure 1:
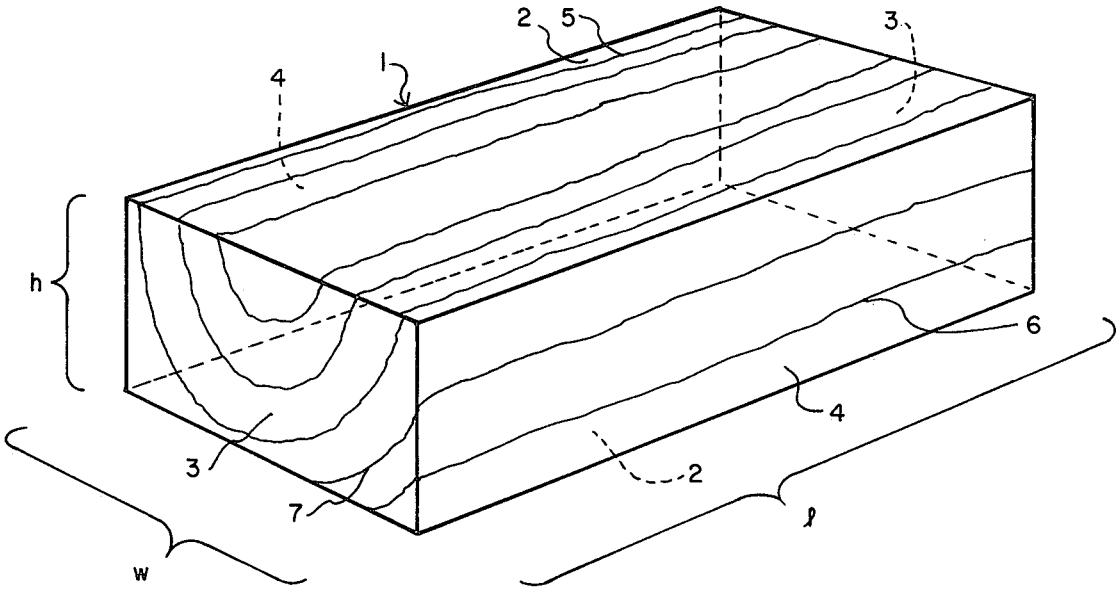
FIG. 1 is a perspective view of a unitary wooden element.

The tie of this invention is composed of wooden elements 1, FIG. 1, whose length, width and height are respectively indicated as l, w, and h.

The faces 2 of element 1 have grains 5 extending longitudinally along the faces 2. The sides 4 also have side-grains 6 extending longitudinally along the sides 4. The ends 3 have end-grains 7 which, as viewed in FIG. 1, have generally arched extension. The grains 5, 6 and 7 shown in FIG. 1 are a result of the growth characteristics of trees. The hereafter referred to stubs conform to element 1, however, have a relatively short length. One reasonably skilled in the art of cutting timber will know the proper procedure for cutting timber to derive an element generally conforming to element 1.

Figure 2:
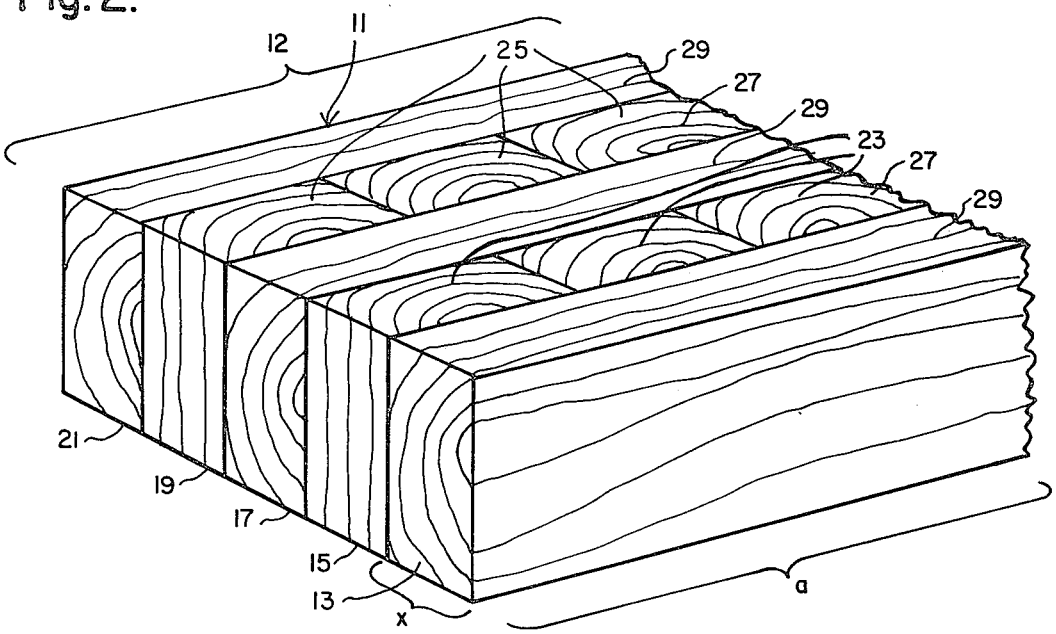
FIG. 2 is a perspective view of a laminated cross-grain tie.

The cross-grain railroad crosstie 11, FIG. 2, is comprised of laminae 13, 15, 17, 19 and 21, each lamina having the same overall dimensions. Laminae 13, 17 and 21 are unitary wooden elements, each being so oriented that the side-grains 29 form a part of the load bearing surface 12. Laminae 13 and 21 form outer layers and lamina 17 forms an inner layer.

Laminae 15 and 19 are each comprised of a series of wooden stubs 23 and 25 that have a length corresponding to the width of the other laminae 13, 17 and 21. Stubs 23 and 25 are aligned with respect to one another within each lamina so that the sides of adjacent stubs 23 or 25 are in contact with one another. Each stub 23 or 25 has its end-grains 27 forming a part of the bearing surface 12.

The stubs 23 which form lamina 15 are not bonded to each other as is also the case with stubs 25 which form lamina 19. Stubs 23 and 25 can be adhesive bonded together but to do so would increase cost and may substantially lower the bending capability of a tie. In the preferred embodiment, stubs 23 and 25 are not bonded to each other but are bonded to adjacent lamina 13, 17 or 21.

The laminae 13, 15, 17, 19 and 21 are bonded together with a bonding agent or adhesive placed between adjacent laminae 13, 15, 17, 19 and 21.

To ascertain the wear characteristic of a softwood tie made in accordance with this invention, a partial tie A (the tie length A was less than an actual tie) was constructed and tested. Tie A was composed of softwood (southern yellow pine) in accordance with the aforedescribed tie 11, FIG. 2. The bonding agent was phenol-resorcinol-formaldehyde adhesive (sold under the trademark Penacolite) which was employed in all herein described softwood test ties. Laminae 13, 17, and 21 of tie A were 1 inch thick (x) and laminae 15 and 19 were 2 inches thick. Tie A was fitted with a 7-inch by 14-inch steel tie plate and a piece of 132 pound rail and tested for 2.38 million cycles in an Association of American Railroad Tie Wear Machine (TWM) which subjects a specimen to a load condition comparable to that on the outer rail of a sharp curve as determined from field investigation. A load condition comprised of a vertical load component averaging 20,000 pounds with horizontal components of 7,500 pounds outwardly and 3,750 pounds inwardly directed was applied at a rate of 129 cycles per minute for roughly 2,500,000 cycles or 5,000,000 application of loads with full release between applications. The load cycles simulate the load condition in which a tie in normal use is subjected to in 10 to 15 years. At the end of the test, the average indentation in the tie plate area or wear area of the tie A was 0.04 to 0.05 inch. These results compare favorably with similar previous tests performed on a solid oak tie tested at 2.5 million cycles which displayed indentations of 0.05 to 0.15 inch after testing.

The hereinafter described alternative preferred embodiments are made entirely of wooden elements generally conforming to element 1, shown in FIG. 1.

Figure 4:
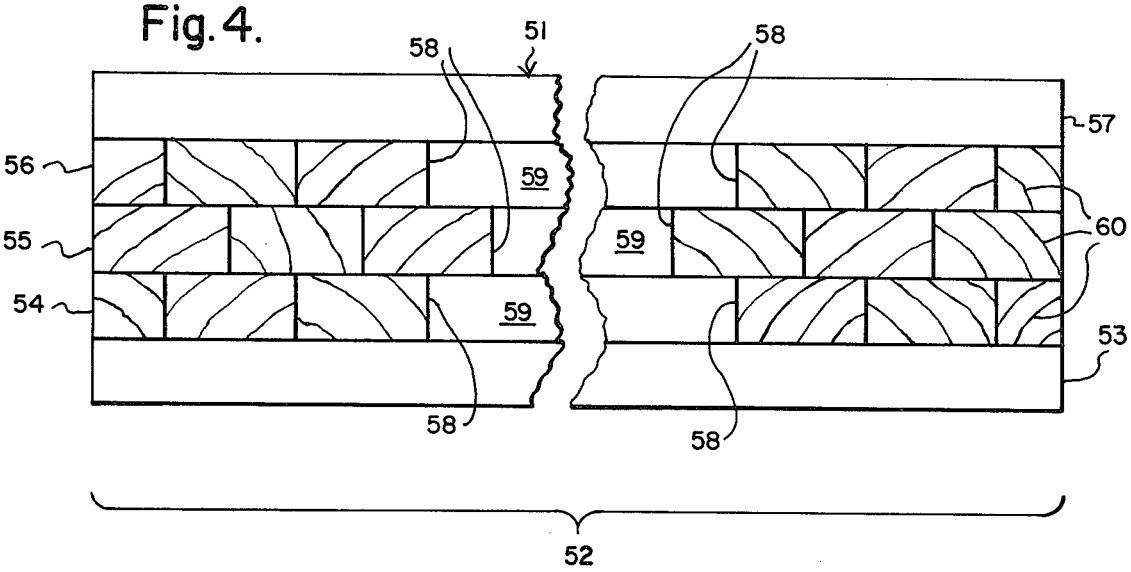
FIG. 4 is a top view of a first alternative of the present invention.

A second embodiment of a cross-grain crosstie of this invention, crosstie 51, FIG. 4, is comprised of a plurality of laminae 53, 54, 55, 56 and 57, respectively, each lamina having the same overall dimensions. Laminae 53 and 57 are unitary wooden elements placed with their respective side surfaces 4 to form part of the load bearing surface 52. Laminae 54, 55 and 56 are each comprised of a plurality of wooden stubs 58 and an element 59. Each lamina 54, 55 and 56 has a plurality of stubs 58 at the longitudinal extremes separated by an element 59. Stubs 58 have their corresponding surface 3 forming part of the load bearing surface 52. Element 59 has either the corresponding surface 2 or 4 forming part of the load bearing surface 52. The stubs 58 are positioned longitudinally along the tie 51 to receive any applied load. The laminae 53, 54, 55, 56 and 57 are bonded together, the bonding agent being placed between adjacent laminae. The stubs 58 are aligned within laminae 54, 55 and 56 such that the sides of adjacent stubs 58 are in contact.

Figure 5:
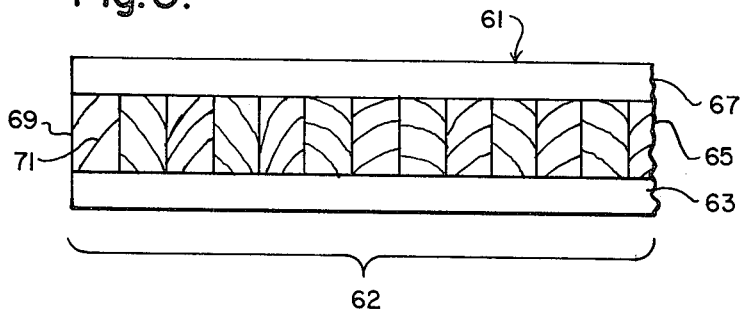
FIG. 5 is a top view of a second alternative of the present invention.

A second embodiment cross-grain crosstie 61, FIG. 5, is shown. Crosstie 61 is comprised of a plurality of laminae 63, 65 and 67, respectively. Laminae 63 and 67 are unitary wooden elements oriented to have their respective side surface 4 forming part of the load bearing surface 62. Laminae 63 and 67 have the same general overall dimensions. Lamina 65 is comprised of a plurality of wooden stubs 69. Stubs 69 have their corresponding surface 3 forming part of the load bearing surface 62. Unlike the aforedescribed and hereinafter described crossties, stubs 69 are aligned within lamina 65 such that their face surface 2 of adjacent stubs 69 contact and the side surface 4 of stubs 69 contact surface 2 of laminae 63 and 67. The laminae 63, 65 and 67 are bonded together, the bonding agent being placed between adjacent laminae 63, 65 and 67.

Figure 6:
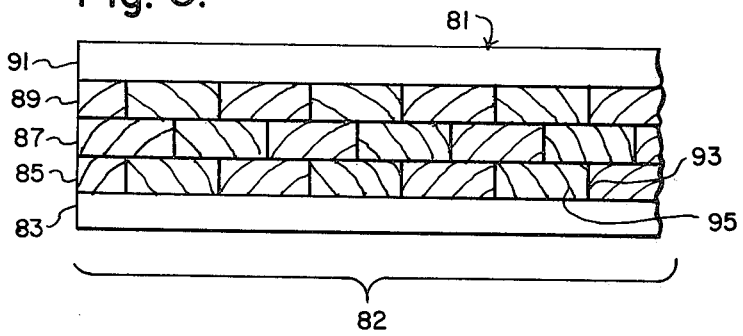
FIG. 6 is a top view of a third alternative of the present invention.

Cross-grain crosstie 81, FIG. 6, is comprised of a plurality of laminae 83, 85, 87, 89 and 91, respectively, of the same overall dimensions. Laminae 83 and 91 are unitary wooden elements placed with their respective side surface 4 forming part of the load bearing surface 82. Laminae 85, 87 and 89 are each comprised of a plurality of wooden stubs 93. Stubs 93 have their corresponding surface 3 forming part of the load bearing surface. Stubs 93 are aligned within each lamina 85, 87, 89 such that their corresponding side 4 is in contact with adjacent stubs 93. The stubs 93 are not aligned across tie 81 to facilitate a greater resistance to a transverse directed load. A bonding agent is placed between adjacent laminae 83, 85, 87, 89 and 91.

Figure 7:
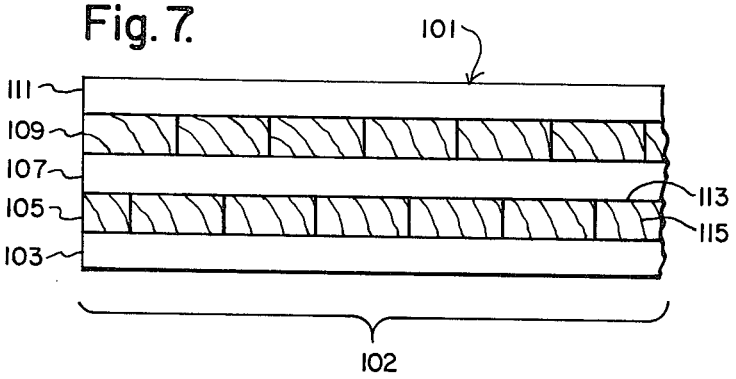
FIG. 7 is a top view of a fourth alternative of the present invention.

Cross-grain crosstie 101, FIG. 7, is comprised of a plurality of laminae 103, 105, 107, 109 and 111, respectively, of the same overall dimensions. Laminae 103, 107 and 111 are unitary wooden elements placed with their respective side surface 4 forming part of the load bearing surface 102. Laminae 105 and 109 are each comprised of a plurality of stubs 113. Stubs 113 have their corresponding surface 3 forming part of the load bearing surface 102. Stubs 113 are aligned within laminae 103, 107 and 111 such that their corresponding side 4 is in contact with adjacent stubs 113. A bonding agent is placed between adjacent laminae. Tie 101 is unlike tie 11 (refer to FIG. 2) in that the stubs 113 of lamina 105 are not aligned to stubs 113 of lamina 109.

To further realize the potential of the present invention, aforedescribed tie A was subjected to three cycle vacuum pressure delamination tests, performed as specified by the *American Society for Testing and Materials* (ASTM-D2559-72). Total delamination was less than 1 percent. Such limited delamination indicates that the cross-grain construction is sufficient to offset the stress generated by the anisotropic properties of wood.

A partial tie B was constructed of red oak laminae $1\frac{3}{4}$ inches in thickness in conformity with the aforedescribed tie 11 and tested in the TWM in accordance with the procedure for tie A, except that after 2,500 cycles, the tie plate was covered with sand, and water was sprayed on the tie surface several times a day to increase the plate cutting action. The bonding agent was resorcinol-formaldehyde adhesive (sold under the trademark Penacolite) which was employed in all herein described hardwood test ties. At 1.3 million cycles, the tie was cooled in a dry ice bath (saturated calcium chloride) for a day to approximately −40° F. while testing cycles continued. At 1.8 million cycles the tie was heated with lamps for 16 hours to approximately 170° F., the temperature cycle briefly simulating rather extreme climate conditions. After 2.52 million cycles the tie B was removed from the tie wear machine. The tie B displayed only slight indentation occurring; the maximum indentation was 0.027 inch and the average of 21 measurements in the tie plate area was 0.018 inch.

A partial tie C, identical to tie B, was treated with a preservative comprising 60 percent by weight of a creosote. The main constituents of creosote have been classified by W. P. K. Findlay in "Preservation of Timber", Adams and Charles Black, London, 1962 as: (1) tar acids such as phenol, creosol, and xylenol, etc., and (2) tar bases such as pyridine, quinoline and acridine, and (3) neutral oils such as a mixture of naphthalene, anthracene and other neutral hydrocarbons.

The retention of creosote within the tie stub was higher than normal (11.2 pcf vs. approximately 7 pcf) due to the short vertical stubs 23 and 25 being thoroughly impregnated. Since the indentation of tie B was so slight, tie C was tested without a tie plate beneath the fitted 132 pound rail and a cant was created in the wood of a 1 unit rise to 40 unit rise. During the wear test, severe rocking motion of the rail base against the tie wearing surface developed due to the inability to construct the perfect cant. Sand and water were added and the temperature was cycled (−40° F. to 140° F.) during the wear test as was done to tie B. At approximately 1 million cycles the cant was lost and the rail rocked severely for the remainder of the test. When the test was concluded at 2.55 million cycles, the wear to tie C was at an average indentation of 0.046 inch with a maximum indentation of 0.114. Solid oak ties subjected to comparable test would be expected to display average indentations of 0.25 to 0.50 inch. As observed, the partial ties conforming to the aforedescribed tie 11 composed of hardwood exhibited marked superior wear characteristics to conventional unitary hardwood ties. The moisture content of tie C prior to the test was 8 percent. At the conclusion of the test the moisture content of tie C increased from 8 to 10 percent without any apparent effect on the strength to tie C.

A partial tie D, cut off from tie B, and a partial tie E, cut off from the creosote tie C, were subjected to standard compression shear and cycle vacuum pressure delamination tests (ASTM: D2559-72). The cross-grain construction will give rolling shear values which, in softwood, are roughly $\frac{1}{4}$ of the strength of parallel-grain shear results. The partial tie D had shear values of 1,305 psi with 54 percent wood failure. The partial tie E had shear values of 1,144 psi with 64 percent wood failure. The delamination test showed 1.1 percent after the third cycling which further indicated treatment had no deleterious effects on bond performance. Although the wood was observed to have checked (relatively small splits) and distorted some in contour, no large glue line failure was observed. For both partial ties B and C the thermal heat generated during the tie wear test was less than 2°–3° F. deviation from ambient conditions. If any delamination would have occurred, heat generated due to friction of the laminae rubbing against each other would have raised the internal temperature considerably.

Figure 3:
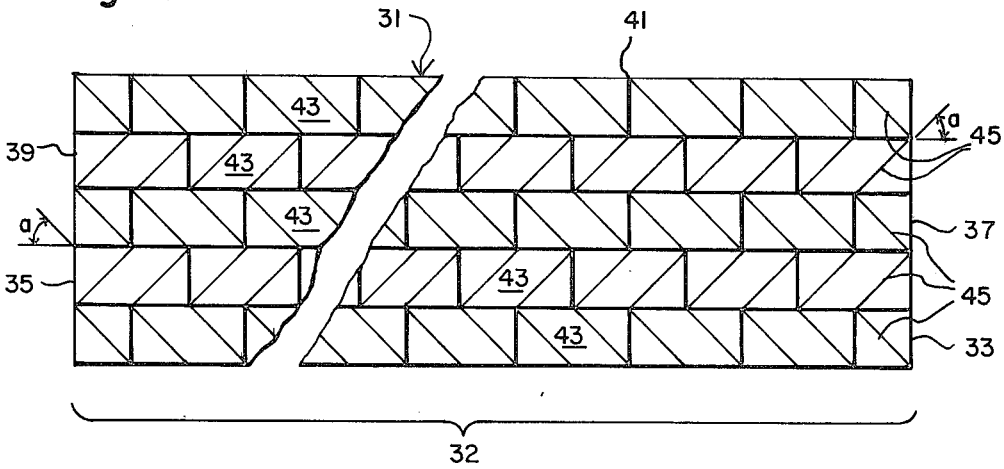
FIG. 3 is a top view of a laminated end-grain tie.

Theoretically, the passage of a train over a crosstie causes the supporting crossties to bend, assuming an arched configuration with respect to the track bed. In order to assess the bending strength of the cross-grain tie, standard bending tests were performed on ties made from southern yellow pine. A crosstie F according to the embodiment 31 was constructed to have a bearing surface 32 comprised entirely of stubs 43 end surface. Tie 31 was comprised of laminae 33, 35, 37, 39 and 41, respectively, each lamina 33, 35, 37, 39 and 41 being comprised entirely of stubs 43 (refer to FIG. 3). The stubs 43 of a particular laminae 33, 35, 37, 39 and 41 are aligned within a lamina such that the sides 4 of adjacent stubs 43 are in contact. To obtain maximum exposure of end-grain 45, it was decided to set the end grains 45 of the individual laminae 33, 35, 37, 39 and 41 at a bias angle "*2a*" relative to end-grains 45 of adjacent laminae 33, 35, 37, 39 or 41, the end-grain 45 of stubs 43 of a particular laminae 33, 35, 37, 39 or 41 being generally parallel. The end-grains 45 are raised through angle "a" from the horizontal. The laminae 33, 35, 37, 39 and 41 were laminated together such that laminae 33, 37 and 41 have their end-grains 45 raised and directed to the left, as viewed in FIG. 3, and laminae 35 and 39 have their end-grains raised and directed to the right, as viewed in FIG. 3. A bonding agent, phenol-resorcinol-formaldehyde, was placed between adjacent laminae 33, 35, 37, 39 or 41. Three crossties G, H, K, in conformity to tie 31, were made having respective angles "a" of 30°, 45° and 60°. These three ties and two other tie configurations of a conventional crosstie L, a cross-grain crosstie M, FIG. 2, and a crosstie N laminated in the conventional manner with the faces (2) of the laminae having the bonding agent and bearing the load. All crossties were 2"×2"×28" which served as a reasonable one-fourth model and each crosstie was comprised of five laminae. Each lamina was approximately 0.4 inch thick. The results from the static bend test are shown in Table I.

TABLE I

STATIC BENDING TEST RESULTS

| TIE CONFIGURATION | | MOR, PSI[a] | MOE, PSI[a](× $10^6$) |
|---|---|---|---|
| (1) Bias Grain Laminated Tie | | | |
| Nominal | Actual | | |
| 30° | 29° | 3,882 | 0.535 |
| 45° | 46° | 2,110 | 0.243 |
| 60° | 59° | 1,470 | 0.167 |
| (2) Cross-Grain Laminated Tie | | 8,694 | 1.112 |
| (3) Conventional Laminated Tie | | 14,405 | 1.650 |
| (4) Unitary SYP[b] Tie | | (12,800) | (1.74) |

[a]Average of three samples.
[b]Average of literature valves for the four species that account for approximately 90% of SYP (southern yellow pine) group.

The static bending test results are expressed in the form of moduli of rupture (MOR) and elasticity (MOE) in Table I. (The lower the MOR, the lower the material strength; the lower the MOE, the greater the elasticity of a material.) The bend test results indicate that the bias grain laminated tie had substantially lower MOR and MOE when compared to a conventional unitary tie.

It is generally conceded that conventional laminated ties are stronger than corresponding unitary ties, due to the wood imperfection of the various laminae being randomly spaced as contrasted with unitary wood ties wherein imperfections are centered in a particular tie region. It is concluded that the MOR values indicated in Table I for the cross-grain conventional laminates are substantially lower than their actual values. The discrepancy between the test value and actual value of the MOR is believed to be due to the fact that one of the outer laminae was substantially thinner (0.3") than the remaining laminae (0.4"), during testing, the thin laminae rupturing prematurely. Noting that during bending, a specimen's upper and lower surfaces are subjected to tensile or compression loads, and that the outer laminae have a primary influence on the tensile strength, the early rupture of the thin outer lamina is felt to have significantly lowered the test results. Therefore, had it not been for the early rupture of the thin outer lamina the MOR for the cross-grain tie would have been substantially higher, indicating more than adequate bending strength.

The results of the aforedescribed test demonstrates the marked superior overall performance characteristics of a cross-grain laminated crosstie as compared to conventional unitary crossties made from comparable wood. The number of laminae or order of laminae is not material to the performance of a cross-grain tie, provided there is sufficient end-grain exposure to applied tie loads. Sufficient end-grain exposure is a matter of judgement based on anticipated load condition and tie material.

As earlier stated, the superior wear performance of cross-grain ties is primarily attributed to the presence of end-grains comprising part of the wear surface. Therefore, increased end-grain exposure is advantageous to tie wear performance. Referring to FIGS. 4, 5, 6 and 7, it is observed that the end-grains 60, 71, 95 and 115 extend generally diagonally across the respective stubs 58, 69, 93 and 113 to increase grain exposure. The relative direction of end-grains 60, 71, 95 and 115 within their respective stubs 58, 69, 93 and 113 to other stubs 58, 69, 93 and 113 is a matter of choice. It is noted that the aforedescribed cross-grain crossties 11, 51, 61, 81, 101 will perform comparably as well if their respective laminae (13, 17, 21), (53, 57), (63, 67), (83, 91) and (103, 107, 111), which laminae have their side surface, corresponding surface 4 of element 1, forming part of the load bearing surface 12, 52, 62, 82, or 102, were reorientated such that the laminae face surface, corresponding surface 2 of element 1, formed part of the load bearing surface 12, 52, 62, 82, or 102.

I claim:

1. A laminated railroad crosstie comprised of at least one lamina including a plurality of wooden stubs oriented such that at least one of said stubs extends the full height of the crosstie, and will receive each imparted load, said load being imparted to said stubs end surface housing said stubs end grain.

2. A laminated railroad crosstie as claimed in claim 1 further comprising at least one lamina consisting of a unitary wooden element orientated to receive loads on at least a part of said element's side or face surface.

3. A laminated railroad crosstie as claimed in claim 1 further comprising at least one wooden member oriented such that the side or face form part of the load bearing surface, said wooden member placed in said lamina between stubs.

4. A crosstie of claim 1 having a plurality of lamina containing said stubs.

5. A crosstie of claim 4 wherein the end-grains of the individual lamina are generally parallel but at a bias angle relative to the end grains of adjacent laminae of from about 30° to about 60° from the horizontal.

6. A crosstie of claim 2 wherein there are a plurality of lamina containing said stubs and a plurality of lamina consisting of a unitary wooden element wherein stub lamina are alternated with unitary wooden element lamina.

7. The crosstie of claim 1 wherein said stubs extend the full height of the crosstie.

* * * * *